United States Patent [19]

Claessens

[11] 4,286,607

[45] Sep. 1, 1981

[54] DEVICE FOR TOBACCO CONSUMPTION AND METHOD OF MAKING IT

[75] Inventor: Dominique F. Claessens, Hilversum, Netherlands

[73] Assignee: D.P.G. Claessens Product-Consultants B.V., Hilversum, Netherlands

[21] Appl. No.: 27,931

[22] Filed: Apr. 6, 1979

[30] Foreign Application Priority Data

Apr. 6, 1978 [NL] Netherlands ..... 7803694

[51] Int. Cl.[3] ..... A24F 47/00; A24F 1/28

[52] U.S. Cl. ..... 131/328; 131/191; 131/187; 131/330

[58] Field of Search ..... 131/172, 171, 191, 192, 131/187, 225, 1, 20 R; 93/80

[56] References Cited

U.S. PATENT DOCUMENTS

| | | | |
|---|---|---|---|
| 21,973 | 11/1858 | Mathews | 131/191 X |
| 216,160 | 6/1879 | DuBois | 131/192 UX |
| 1,144,825 | 6/1915 | Duca | 131/191 |
| 2,655,158 | 10/1953 | Williamson et al. | 131/192 X |
| 3,065,756 | 11/1962 | Davies | 131/191 X |
| 3,409,224 | 11/1968 | Harp et al. | 239/33 |
| 3,593,722 | 7/1971 | Witz | 131/230 X |
| 4,026,019 | 5/1977 | Schiffman | 131/225 |
| 4,046,153 | 9/1977 | Kaye | 131/187 |

*Primary Examiner*—Stephen C. Pellegrino
*Attorney, Agent, or Firm*—Cooper, Dunham, Clark, Griffin & Moran

[57] ABSTRACT

A method of making a device for tobacco consumption, comprising forming an elongated hollow member, forming a mouthpiece at one end of said hollow member and a bowl portion for receiving a plug of tobacco, preferably pre-formed, at the other, and providing means for bending the hollow member at least at one location between the two ends.

This invention further pertains to a device for tobacco consumption comprising a stem portion and a bowl portion with a pre-formed bending place between them.

56 Claims, 9 Drawing Figures

14

17
15
20

17
15
16

19
18
20

20

20

20

DEVICE FOR TOBACCO CONSUMPTION AND METHOD OF MAKING IT

This invention relates to a method of making a device for tobacco consumption, as well as to a device for tobacco consumption.

It is known to consume tobacco by chewing, snuffing or smoking. Tobacco may be smoked as a cigarette, as a cigar or in a pipe. The smoking of a cigar or pipe is generally regarded as a relatively healthy way of consuming tobacco. However, pipe smoking has some disadvantages, which prevent many smokers from, for example, changing from cigarette smoking to pipe smoking. Thus a pipe is relatively expensive and occupies a considerable space. Furthermore, it is not a simple matter to fill a pipe in the correct manner, that is to say, so that it draws well and need not be re-lit many times. Also, a pipe needs to be cleaned regularly. Furthermore, the manufacture of a tobacco pipe is relatively complicated. Finally, a pipe smoker has to carry with him more than one pipe, and possibly more than one kind of tobacco.

There is, accordingly, a need for a possibility of tobacco consumption which has the advantages but not the drawbacks of pipe smoking, and in particular is also acceptable to cigarette smokers.

It is an object of the present invention to provide a method of making a device for consuming tobacco, which meets this need. According to the invention, a method of making a device for tobacco consumption is characterized by forming an elongated hollow member; forming a mouthpiece at one end of said hollow member; forming the other end of the hollow member so that it can be provided with a plug of tobacco; and providing means at least at one location between the two ends of the hollow member for bending said hollow member.

A device for tobacco consumption is characterized, according to the invention, by an elongated hollow member which on one end, the stem, has a mouthpiece, and at the other, the bowl, can take up a pre-formed tobacco plug.

The invention will be described in more detail hereinafter with reference to the accompanying drawings.

FIG. 1 shows diagrammatically an example of an apparatus for making a device according to the invention;

FIGS. 2*a*–2*j* diagrammatically show stepwise in what way, according to the invention, an elongated hollow member for tobacco consumption is bent;

FIGS. 3*a*–3*j* diagrammatically show a variant of the embodiment of FIGS. 2*a*–2*j;*

FIGS. 4*a*–4*j* diagrammatically show a second variant of the embodiment of FIGS. 2*a*–2*j;*

FIGS. 5*a*–5*k* diagrammatically show a third variant of the embodiment of FIGS. 2*a*–2*j;*

FIGS. 6*a* and 6*b* diagrammatically show a fourth variant of the embodiment of FIGS. 2*a*–2*j;*

Before describing the Figures in more detail, the following is observed. The basic concept of the invention is to provide an elongated hollow member which can serve as a tobacco pipe and, indeed, will hereinafter be designated as a pipe, and which in principle is used once only. For this purpose, the pipe is preferably provided in the factory with a suitable tobacco fill. Nevertheless, the pipe may also be constructed so that it can be used more than once. In that case the pipe may be re-filled with separately sold tobacco fills, which have been pressed into a coherent structure and/or are provided with a combustible envelope.

Such pipes, designed for being used a small number of times only may be extremely inexpensive and can be sold, preferably already provided with a tobacco fill, for example in the manner of cigars in boxes.

By virtue of the use of a pre-formed tobacco fill, provided with an envelope that burns along with the tobacco, or which is placed in a pipe of which at least the bowl portion burns along or melts, the drawback of the frequent extinction of conventional pipes is remedied. For, owing to the fact that the envelope of the tobacco fill, or the bowl of the pipe burns or melts along with the tobacco, sufficient supply of oxygen is ensured, as a result of which the pipe does not go out of its own.

If a compressed tobacco plug is used, the tobacco body may be provided with a plurality of throughbores to improve the supply of oxygen.

In order to approach the form of the conventional pipe, which lies conveniently in the hand, the pipe of the present invention is provided with bending facilities, to be described hereinafter. Bending of the pipe creates a separation between the bowl and the stem. The length ratio of stem and bowl can be selected at will during manufacture. In most embodiments, the bending facilities exist not only during manufacture but also during consumption, so that the smoker may bend the pipe into the form desired by him. If desired, however, the pipe may be left in its straight form.

When the pipe is bent, a restriction is formed, which ensures a good separation between tobacco and stem, which promotes a good draw of the pipe, and results in any condensate formation being localized at the bend.

As the pipe is only used once or several times, there is the possibility of using additional flavouring by means of a filter mounted in the pipe, which filter contains aromatic substances.

Figure 1:
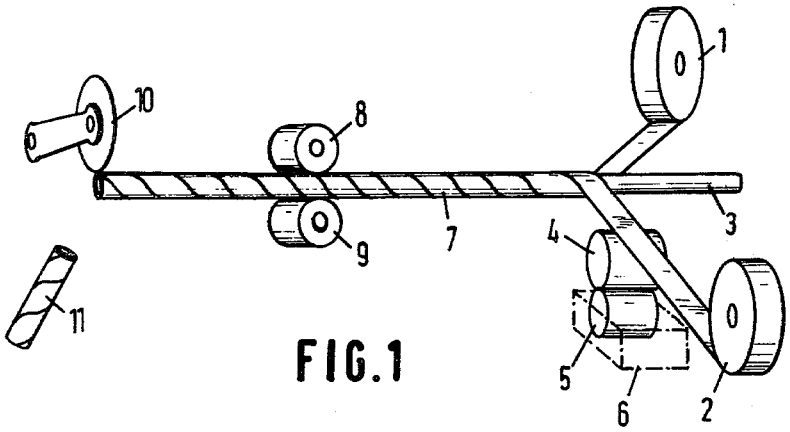

The basic form of the pipe is preferably wrapped from suitable foil or foils, as illustrated in FIG. 1. Nevertheless, the pipe may also be made, for example, by extrusion, stamping, pressing, injection moulding from suitable materials. Such operations do not involve any particular difficulties to those skilled in the art, and these methods of manufacture will not, therefore, be described in more detail herein.

In the method illustrated in FIG. 1, a pipe according to the invention is made by wrapping foils drawn from two rollers, 1, 2 diagonally relatively to each other about a rotary member 3. The foils may each consist of one or more layers, of the same or different materials, and may be provided, for example, with a finishing layer and/or an imprint. Rollers 1 and 2 may carry the same foil or different foils. It is also possible to supply the foil from one roller only, or from more than two rollers. This depends, among other things, on the thickness of the foil and on the effect contemplated. Suitable foil materials are, for example, paper, wood, synthetic plastics materials, which may or may not be provided with a metal coating, for example of aluminium or tin.

In the method illustrated in FIG. 1, the foil web 2 is provided with an adhesive layer before being wrapped. For this purpose the foil is passed over a first roller 4, which is in contact with a second roller 5 partly immersed in a container with adhesive. The foil rollers and the adhesive rollers are supported for rotation on shafts in known manner, not shown.

The continuous tube 7 formed in the manner described is passed between two transporting rollers 8 and 9 and subsequently portions of tube 7 are cut off by means of a cutter 10 to form pipes 11.

The resulting right-cylindrical pipes 11 may, if desired, be left in the right-cylindrical form or made oval or angular. In a preferred embodiment, however, the pipes are made fully or partially conical. A pipe which is conical throughout its length may be produced by gripping the right-cylindrical pipe at its ends by hand or mechanically and rotating in opposite directions. One end is then restricted and the other is broadened, while at the same time a larger wall thickness is formed at the tapered end, which may come to serve as a mouthpiece, so that a conical form is obtained. This should be effected before the adhesive is set. Naturally, it is also possible to rotate only one end and to retain the other. This principle can also be applied if a part of the pipe is to be of conical form only. The right-cylindrical pipe is then held at the desired place between the two ends, and one of the ends is rotated against the direction in which it was wrapped.

The resulting pipe, if a straight form is desired, can be provided with a tobacco plug with an envelope burning along with it, and after possibly being provided with a loose mouthpiece and an imprint, be packed. It is observed that it is also possible for the pipes to be directly made in conical form.

As stated before, the pipes should preferably be bent. A simple possibility of bending is obtained by making the pipes of separate stem portions and bowl portions, which are connected by a flexible bellows-shaped sleeve. In that embodiment, the stem portion may be of different configuration, such as right-cylindrical, from the bowl portion, which for example may be of funnel-shaped configuration. This, however, is not necessary.

FIG. 2 shows diagrammatically in what way a one-piece pipe can be bent.

Figures 2A, 2B, 2C, 2D, 2E, 2F, 2G, 2H, 2I, 2J:
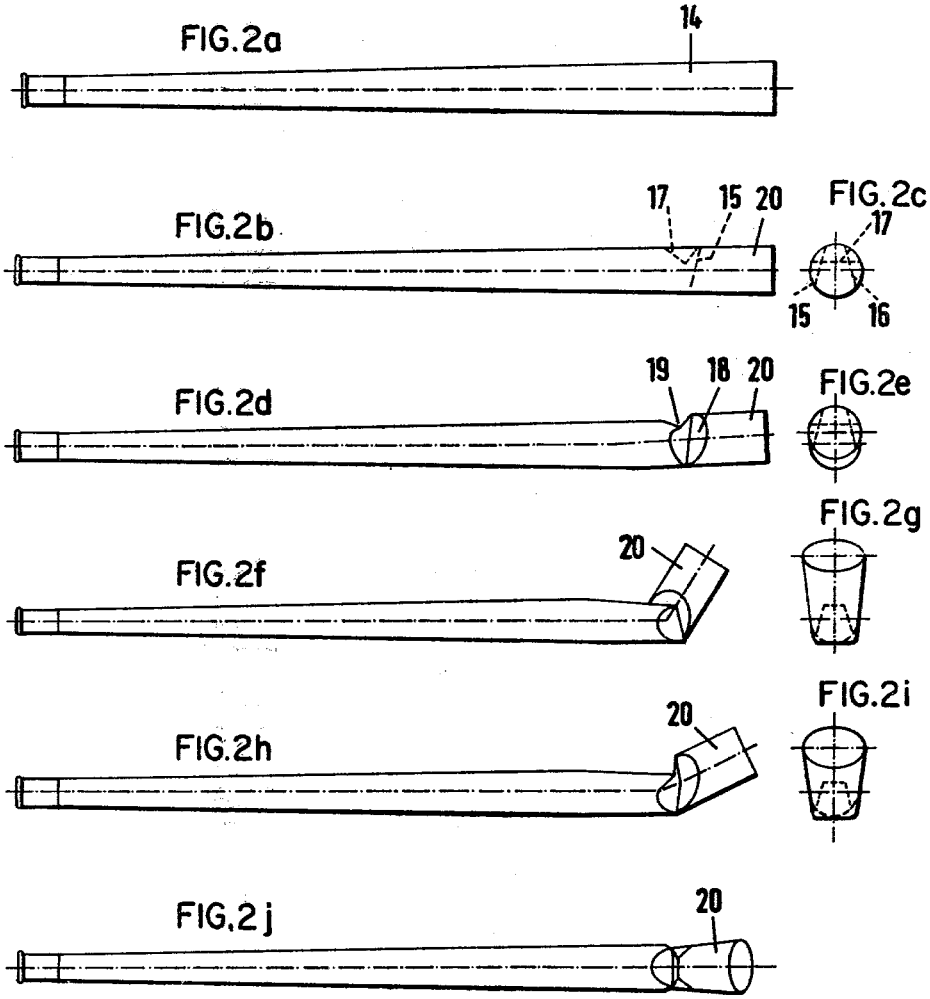

FIG. 2*a* shows a conical blank 14. FIGS. 2*b* and 2*c* illustrate, by means of interrupted lines, the main lines of indents to be made in the wall of the pipe to provide bending facilities. Lines 15 and 16 (also see the front-elevational view of FIG. 2*c*) indicate two indents 18 to be made opposite to each other (FIG. 2*d*). The lines make a relatively large angle with the axis of the pipe and in front view extend upwardly slightly towards one another. Line 17 indicates an indent 19 (FIG. 2*d*) to be made transversely to the plane of the drawing. Indent 19 is located slightly further away from the bowl portion 20 of the pipe than are indents 18.

The indents can be made with a straight, blunt object, if necessary with the help of a counter-mould, not shown, which is inserted in the pipe to support it and limit the indents. Such a counter-mould may consist, for example, of a slightly tapered body which at the desired places is provided with recesses corresponding with the indents to be made.

After the indents have been made, the pipe can be bent. Various positions are possible, as shown in FIG. 2*f* and 2*g*, and in FIG. 2*h* and FIG. 2*i*, respectively. Bending can be effected both during manufacture and in use. Also, the position of the bowl elected during manufacture may be changed by the user. FIG. 2*j* shows a plan view of a pipe bent in the manner outlined.

FIG. 3 shows a different possibility of bending a pipe according to the invention. The main lines of the indents to be made are here designated by 21, 22 and 23. Lines 21 and 22 extend approximately V-shaped relatively to each other and indicate indents 24, 25 to be made on the visible side of the pipe and on the opposite, non-visible side. Line 23 indicates an indent 26 to be made transverse to indents 24 and 25 at the top. Indent 26 lies between the legs of the V-shape formed by indents 24 and 25.

Figure 3A:
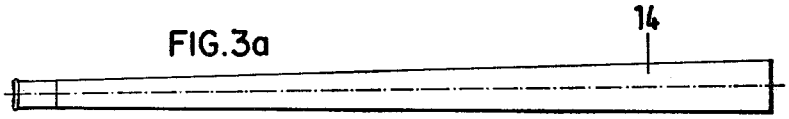
Figure 3B:
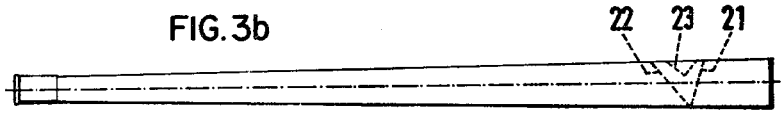
Figure 3C:
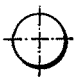
Figure 3D:
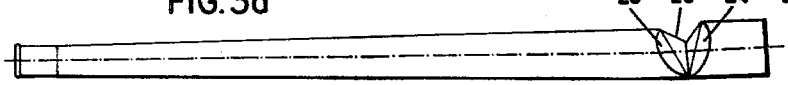
Figure 3E:
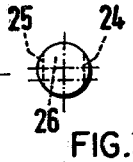
Figure 3F:
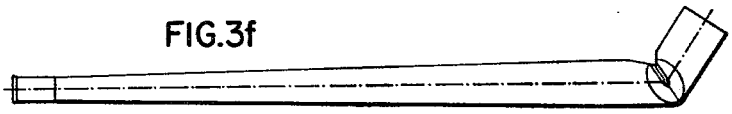
Figure 3G:
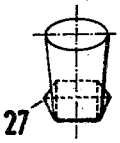
Figure 3H:
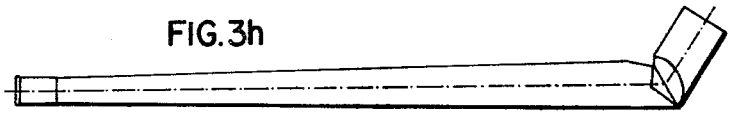
Figure 3I:
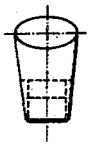
Figure 3J:
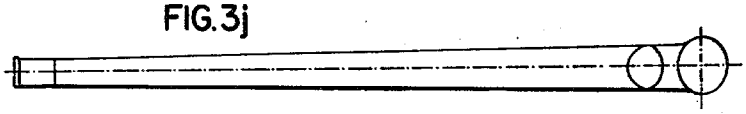
Figure 4A:
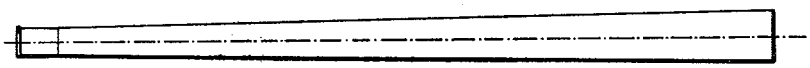
Figure 4B:
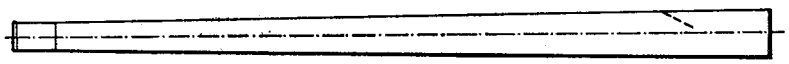
Figure 4C:
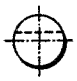
Figure 4D:
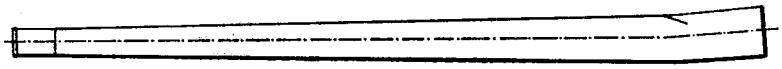
Figure 4E:
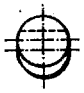
Figure 4F:
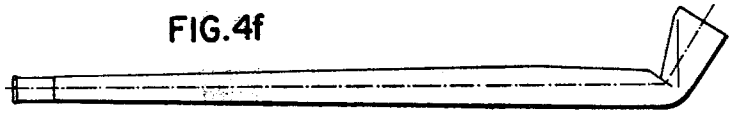
Figure 4G:
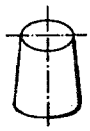
Figure 4H:
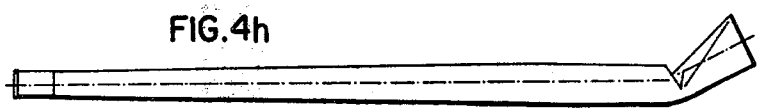
Figure 4I:
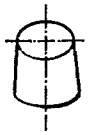
Figure 4J:
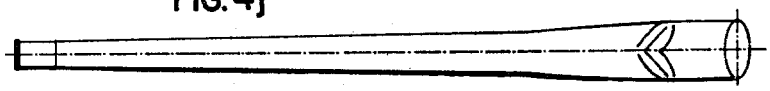
Figure 5A:
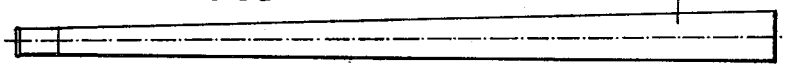
Figure 5B:
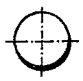
Figure 5C:
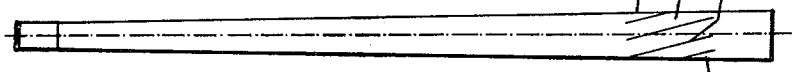
Figure 5D:
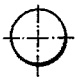
Figure 5E:
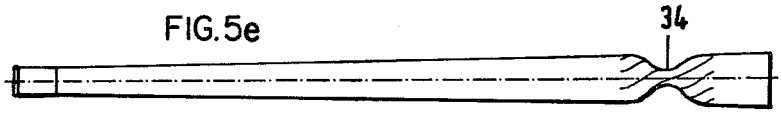
Figure 5F:
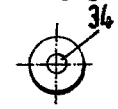
Figure 5G:
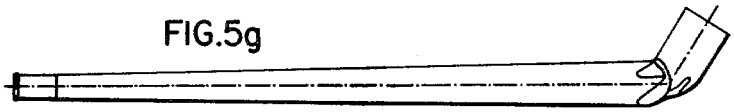
Figure 5H:
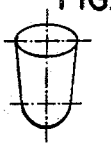
Figure 5I:
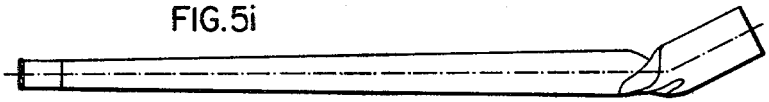
Figure 5J:
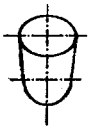
Figure 5K:
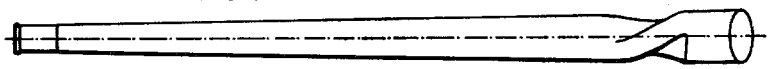

FIGS. 3*f* and 3*g* show the result after bending. If the resulting projections 27 are pushed inwardly, the configuration of FIGS. 2*h* and 2*i* is obtained. FIG. 2*j* shows the pipe thus bent in plan view. The indents can be made in the same manner as described with reference to FIG. 2.

FIG. 4 shows still another possibility of bending a pipe according to the invention, starting from an acute V-shaped indent 28. The result is shown in side-elevational view in FIGS. 4*f* and 4*g* and FIGS. 4*h* and 4*i*, and in plan view in FIG. 4*j*.

FIG. 5 shows still another possibility of bending a pipe according to the invention. In this embodiment, the basic principle is a plurality of indents or ridges 30, 31, 32 and 33 making a relatively small angle with the axis of the pipe, and which enable the bowl of the pipe to be rotated relatively to the stem to form a constriction 34 (FIG. 5*e* and 5*f*). At the constriction the pipe can be bent. The result is shown in FIGS. 5*i* and 5*j* (side-elevational view) and in FIG. 5*k* (plan view).

Figure 6A:
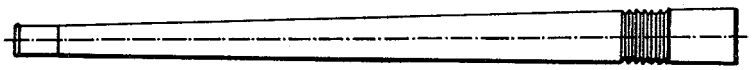
Figure 6B:
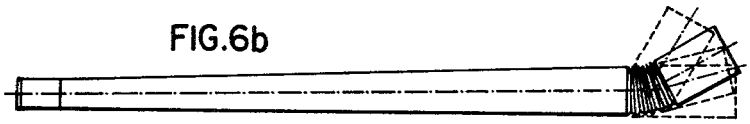

According to FIG. 6, a pipe according to the invention is provided with a plurality of ridges extending around and perpendicular to the axis of the pipe to form a kind of bellows which allows bending of the pipe into various positions.

Starting from the basic concepts described and shown with regard to the bending of a pipe according to the invention, and in particular one made of foil, still other possibilities of bending are conceivable, which, however, are not shown but considered to fall within the framework of the invention.

Pipes not made of foil, but manufactured in any of the other manners described can be bent, for example, in a mould with or without the addition of heat.

As a matter of interest it is further noted that the bending techniques described are not limited to the conical pipe as shown, but are also applicable to other forms and cross-sectional configurations.

After the formation of a pipe according to the invention in the manner described, the tobacco fill and possibly the mouthpiece of the pipe can be applied. It is not necessary in all cases to provide a separate mouthpiece. This depends, among other things, on the material used for the pipe. If a separate mouthpiece is provided, this can be separately formed in a manner known in the art, and pushed into or around the end of the stem. The mouthpiece can be fastened by clamping or using a suitable adhesive. Furthermore, the mouthpiece may comprise a filter which may or may not contain aromatic substances. However, such a filter can also be mounted at a different location in the stem or in the bowl of the pipe. It is conceivable that the pre-formed tobacco plug to be placed in the bowl is first provided with a filter and only then put in the bowl.

Figure 7:
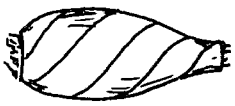
FIG. 7 shows an example of a tobacco fill according to the invention.
Figure 8:
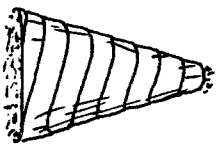
FIG. 8 shows a variant of the tobacco fill of FIG. 7.

The fill of the pipe may consist of a tobacco roll or a tobacco cone. FIGS. 7 and 8 show examples of a suitable tobacco roll and cone, respectively.

If the end of the bowl of the pipe does not consist of a foil burning or melting along with the burning tobacco, which foil may be of pure tin, for example, the tobacco plug proper should be provided with an envelope that burns along with it, and possibly melts along with it. Such an envelope may for example consist of cigarette paper or of tobacco leaf. The tobacco plug may be fastened in or on the pipe bowl by glueing or clamping. An envelope melting along with the tobacco may consist of a pure tin foil. Such a tin foil does not affect the taste and is non-toxic.

Figure 9:
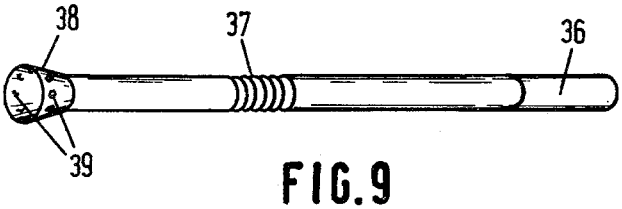
FIG. 9 shows an embodiment of a device according to the invention.

FIG. 9 shows a pipe according to the present invention with a substantially straight right-cylindrical shape, which is provided with an inserted mouthpiece 36, a bellows-shaped flexible place 37 and a short funnel-shaped bowl portion 38.

The bowl portion is provided with pointed projections 39 which contribute to the tobacco plug being properly held.

The smoking period of the pipe is determined by the amount of tobacco, the kind of tobacco, and the degree to which the tobacco has been compressed. With a greatly compressed fill, a long smoking period can be obtained with a small volume. Compression can be effected in a suitably formed mould. In order to promote the supply of oxygen in such a compressed plug of tobacco, pins may be inserted during or after compression to provide oxygen supplying apertures in the tobacco plug.

I claim:

1. A method of making a device for tobacco consumption, which comprises forming an elongated hollow member; forming a mouthpiece on one end of said hollow member; forming the other end of the hollow member so that the same can be provided with a tobacco plug; and providing means at least at one position intermediate the two ends of the hollow member for bending said hollow member by making two oppositely-located indents in the wall of the member and a third indent extending transversely to said indents and to the longitudinal axis of the member, said third indent being retracted somewhat relative to the plane containing the first two indents.

2. A method of making a device for tobacco consumption, which comprises forming an elongated hollow member; forming a mouthpiece on one end of said hollow member; forming the other end of the hollow member so that the same can be provided with a tobacco plug; and providing means at least at one position intermediate the two ends of the hollow member for bending said hollow member by providing two oppositely-located, approximately V-shaped indents, as well as a third indent extending transversely to said indents and to the longitudinal axis of the member, said third indent being located within the open ends of the V-shapes.

3. A method of making a device for tobacco consumption, which comprises forming an elongated hollow member; forming a mouthpiece on one end of said hollow member; forming the other end of the hollow member so that the same can be provided with a tobacco plug; and providing means at least one position intermediate the two ends of the hollow member for bending said hollow member by forming two indents in the wall of the member, which together are V-shaped, the longitudinal axis of the member being located in the bisectrix plane of the V-shape.

4. A method of making a device for tobacco consumption, which comprises forming an elongated hollow member; forming a mouthpiece on one end of said hollow member; forming the other end of the hollow member so that the same can be provided with a tobacco plug; and providing means at least at one position intermediate the two ends of the hollow member for bending said hollow member by providing a plurality of side-by-side, substantially parallel indents in the wall, which indents make an acute angle with the longitudinal axis of the member and make possible rotation of one end relative to the other end, whereafter bending is possible.

5. A method of making a conical hollow member from foil for tobacco consumption, which comprises winding one or more foil webs in offset relationship to form a continuous cylindrical tube, with at least one web being provided with an adhesive prior to winding; cutting the cylindrical tube into pieces of a desired length; and producing the conical shape by further winding one of the ends of each cutoff piece while the other end is retained or rotated in the opposite direction; and wherein the hollow member is provided with a bending facility by making two oppositely-located indents in the wall of the member and a third indent extending transversely to said indents and to the longitudinal axis of the member, said third indent being retracted somewhat relative to the plane containing the first two indents.

6. A method of forming a conical hollow member from foil for tobacco consumption wherein at least one strip of foil is provided with an adhesive layer and is wound in obliquely of off-set relationship while a tensile force is exercised on the portion already wound to produce at least partially a conical shape and wherein the hollow member is provided with a bending facility by making two oppositely-located indents in the wall of the member and a third indent extending transversely to said indents and to the longitudinal axis of the member, said third indent being retracted somewhat relative to the plane containing the first two indents.

7. A method according to claims 1, 2, 3, or 4 wherein said elongated hollow member is formed from a foil.

8. A method according to claims 1, 2, 3, or 4 wherein said foil is paper.

9. A method according to claims 7, 5, or 6 wherein said foil is a synthetic plastics foil.

10. A method according to claims 7, 5, or 6 wherein said foil is wood foil.

11. A method according to claims 7, 5, or 6 wherein said foil is coated with metal.

12. A method according to claims 1, 2, 3 or 4 wherein said elongated hollow member is formed by stamping.

13. A method according to claims 1, 2, 3 or 4 wherein said elongated hollow member is formed by injection moulding.

14. A method according to claims 1, 2, 3, or 4 wherein said elongated hollow member is formed by extrusion.

15. A method according to claims 1, 2, 3 or 4 wherein said elongated hollow member is formed by pressing.

16. A method according to claims 1, 2, 3, or 4 wherein said elongated hollow member is given a conical shape, the small end being the mouthpiece end and the big end being capable of receiving a tobacco plug.

17. A method according to claims 1, 2, 3, or 4, in which a loose mouthpiece member is made, which is applied at the mouthpiece end of the elongated hollow member.

18. A method according to claims 1, 2, 3, or 4 wherein at least the end of the elongated member for receiving a tobacco plug, the bowl, is made of a foil which burns or melts along with the tobacco.

19. A method according to claims 1, 2, 3, or 4, wherein a tobacco plug surrounded by a foil burning or melting along with the tobacco is formed, which is secured to the bowl of the elongated hollow member.

20. A method according to claim 19, wherein said foil burning along with the tobacco is cigarette paper.

21. A method according to claim 19, wherein said foil burning along with the tobacco is tobacco leaf.

22. A method according to claim 19, wherein said foil melting along with the tobacco is a foil of pure tin.

23. A method according to claims 1, 5, or 6, wherein at least one filter is provided in the hollow member or in a separately made mouthpiece.

24. A method according to claim 23, wherein said filter comprises aromatic materials.

25. A method according to claim 1 wherein said elongated hollow member is formed by winding one or more elongated strips of foil in off-set relationship.

26. A method according to claim 25, wherein at least one strip of foil is provided with an adhesive film prior to winding.

27. A method according to claim 25 or 26, wherein at least two kinds of foils are used.

28. A method according to claim 25 or 5, wherein at least one of the foils is a foil which burns along with the tobacco.

29. A method according to claims 5 or 6 wherein a tobacco plug surrounded by a foil burning or melting along with the tobacco is formed and secured to one end of the hollow member.

30. A method according to claim 29 wherein said foil burning along with the tobacco is cigarette paper.

31. A method according to claim 29, wherein said foil burning along with the tobacco is tobacco leaf.

32. A method according to claim 29, wherein said foil melting along with the tobacco is a foil of pure tin.

33. A device for tobacco consumption, characterized by an elongated hollow member having means at one end, the stem, for receiving a mouthpiece and means at the other end, the bowl, for receiving a preformed tobacco plug and means in a zone between said two ends for facilitating bending by a user to form an angle between the stem and the bowl, said means for facilitating bending comprising two oppositely-located indents in the wall of said hollow member and a third indent extending transversely to said two indents and to the longitudinal axis of said hollow member, said third indent being slightly displaced relative to the plane containing said two indents for providing a bending facility.

34. A device for tobacco consumption, characterized by an elongated hollow member having means at one end, the stem, for receiving a mouthpiece and means at the other end, the bowl, for receiving a preformed tobacco plug and means in a zone between said two ends for facilitating bending by a user to form an angle between the stem and the bowl, said means for facilitating bending comprising two approximately V-shaped indents formed opposite to each other in the wall of said elongated member and a third indent extending transversely to the longitudinal axis of said elongated member and two said V-shaped indents, said third indent being located within the open ends of said V-shaped indents for providing a bending facility.

35. A device for tobacco comsumption, characterized by an elongated hollow member having means at one end, the stem, for receiving a mouthpiece and means at the other end, the bowl, for receiving a preformed tobacco plug and means in a zone between said two ends for facilitating bending by a user to form an angle between the stem and the bowl, said means for facilitating bending comprising two indents in the wall of said elongated member which together are V-shaped with the longitudinal axis of said elongated member being located in the bixectrix plane of the V-shaped for providing a bending facility.

36. A device for tobacco consumption, characterized by an elongated hollow member having means at one end, the stem, for receiving a mouthpiece and means at the other end, the bowl, for receiving a preformed tobacco plug and means in a zone between said two ends for facilitating bending by a user to form an angle between the stem and the bowl, said means for facilitating bending comprising a plurality of side-by-side, substantially parallel indents in the wall of said elongated member, said indents making an acute angle with the longitudinal axis of said elongated member and facilitating rotation of the bowl relative to the stem by a user whereafter bending is possible.

37. A device as claimed in claims 33, 34, 35, or 36, wherein the elongated hollow member comprises at least one wound foil.

38. A device as claimed in claim 37, wherein the foil of the bowl portion comprises a material capable of burning or melting along with the tobacco plug.

39. A device as claimed in claims 33, 34, 35 or 36, wherein the elongated hollow member is conical, the small end being provided with a mouthpiece and the big end being capable of receiving a pre-formed tobacco plug.

40. A device as claimed in claims 33, 34, 35 or 36 and including a pre-formed tobacco plug.

41. A device as claimed in claim 40, wherein the pre-formed tobacco plug comprises a portion of tobacco, a foil enveloping the tobacco portion and capable of burning or melting along with the tobacco, and adhesive means for connecting the foil to the bowl of the elongated member.

42. A device as claimed in claims 33, 34, 35, or 36, further comprising a filter provided in the elongated hollow member.

43. A device as claimed in claim 42, wherein said filter comprises aromatic materials.

44. A device as claimed in claims 33, 34, 35, or 36, wherein said bowl has been dipped into a ceramic material.

45. A device as claimed in claims 33, 34, 35, or 36, wherein the end for receiving a tobacco plug is provided adjacent to the rim of the receiving opening with a plurality of pointed indents capable of engaging into the tobacco plug for retaining the same.

46. A device as claimed in claims 33, 34, 35, or 36 further comprising a mouthpiece containing a filter comprising aromatic materials.

47. A method of making a conical hollow member from foil for tobacco consumption, which comprises winding one or more foil webs in offset relationship to form a continuous cylindrical tube, with at least one web being provided with an adhesive prior to winding; cutting the cylindrical tube into pieces of a desired length; and producing the conical shape by further winding one of the ends of each cutoff piece while the other end is retained or rotated in the opposite direction and wherein the hollow member is provided with a bending facility by providing two oppositely-located, approximately V-shaped indents, as well as a third indent extending transversely to said indents and to the longitudinal axis of the member, said third indent being located within the open ends of the V-shapes.

48. A method of forming a conical hollow member from foil for tobacco consumption, wherein at least one strip of foil is provided with an adhesive layer and is wound in obliquely offset relationship while a tensile force is exercised on the portion already wound to produce at least partially a conical shape, and wherein the elongated hollow member is provided with a bending facility by providing two oppositely-located, approximately V-shaped indents as well as a third indent extending transversely to said indents and to the longitudinal axis of the member, said third indent being located within the open ends of the V-shapes.

49. A method of making a conical hollow member from foil for tobacco consumption, which comprises winding one or more foil webs in offset relationship to form a continuous cylindrical tube, with at least one web being provided with an adhesive prior to winding; cutting the cylindrical tube into pieces of desired length; and producing the conical shape by further winding one of the ends of each cutoff piece while the other end is retained or rotated in the opposite direction and wherein the elongated hollow member is provided with a bending facility by forming two indents in the wall of the member, which together are V-shaped, the longitudinal axis of the member being located in the bisectrix plane of the V-shaped.

50. A method of forming a conical hollow member from foil for tobacco consumption, wherein at least one strip of foil is provided with an adhesive layer and is wound in obliquely offset relationship while a tensile force is exercised on the portion already wound to produce at least a partially conical shape, and wherein the elongated hollow member is provided with a bending facility by forming two indents in the wall of the member, which together are V-shaped, the longitudinal axis of the member being located in the bisectrix plane of the V-shape.

51. A method of making a conical hollow member from foil for tobacco consumption, which comprises winding one or more foil webs in offset relationship to form a continuous cylindrical tube, with at least one web being provided with an adhesive prior to winding; cutting the cylindrical tube into pieces of a desired length; and producing the conical shape by further winding one of the ends of each cutoff piece while the other end is retained or rotated in the opposite direction, and wherein the elongated hollow member is provided with a bending facility by providing a plurality of side-by-side, substantially parallel indents in the wall, which indents make an acute angle with the longitudinal axis of the member and make possible a rotation of one end relative to the other, whereafter beinding is possible.

52. A method of forming a conical hollow member from foil for tobacco consumption, wherein at least one strip of foil is provided with an adhesive layer and is wound in obliquely offset relationship while a tensile force is exercised on the portion already wound to produce at least partially a conical shape, and wherein the elongated hollow member is provided with a bending facility by providing a plurality of side-by-side, substantially parallel indents in the wall, which indents make an acute angle with the longitudinal axis of the member and make possible a rotation of one end relative to the other, whereafter bending is possible.

53. A method according to claims 47, 48, 49, 50, 51, or 52, wherein said foil is paper.

54. A method according to claims 47, 48, 49, 50, 51, or 52, wherein said foil is a synthetic plastics foil.

55. A method according to claims 47, 48, 49, 50, 51, or 52, wherein said foil is a wood foil.

56. A method according to claims 47, 48, 49, 50, 51, or 52, wherein said foil is coated with metal.

* * * * *

UNITED STATES PATENT AND TRADEMARK OFFICE

CERTIFICATE OF CORRECTION

PATENT NO. : 4,286,607

DATED : September 1, 1981

INVENTOR(S) : Dominique F. Claessens

It is certified that error appears in the above-identified patent and that said Letters Patent are hereby corrected as shown below:

Column 6, line 44, "claims 1, 2, 3, or 4"should read --claims 7, 5, or 6--.

Column 9, line 33, "V-shaped" should read --V-shape--.

Signed and Sealed this

Fourth Day of May 1982

[SEAL]

Attest:

GERALD J. MOSSINGHOFF

Attesting Officer

Commissioner of Patents and Trademarks